United States Patent [19]

Carella

[11] 4,003,576

[45] Jan. 18, 1977

[54] ARROW

[76] Inventor: Richard F. Carella, 35572 Strathcona Drive, Mount Clemens, Mich. 48043

[22] Filed: Oct. 1, 1973

[21] Appl. No.: 402,303

[52] U.S. Cl. ..... 273/106.5 C; 244/3.23

[51] Int. Cl.[2] ..... F41B 5/02

[58] Field of Search ..... 273/106.5 C; 244/3.23–3.29

[56] References Cited

UNITED STATES PATENTS

| | | | |
|---|---|---|---|
| 219,881 | 9/1879 | Streeter | 273/106.5 C |
| 1,648,376 | 11/1927 | Blodgett | 273/106.5 C |
| 1,883,758 | 10/1932 | Brandt | 244/3.24 |
| 2,887,319 | 5/1959 | Lay | 273/106.5 C |

*Primary Examiner*—Paul E. Shapiro
*Attorney, Agent, or Firm*—McGlynn and Milton

[57] ABSTRACT

An arrow comprising a shaft with forward and rearward ends. An integral plastic vane member extends along the shaft adjacent the rearward end and includes first and second vanes spaced from the shaft by a pair of spaced generally parallel support vanes. The support vanes are interconnected by a base portion which may take one of various configurations for engaging the arrow shaft. The first and second vanes are generally triangular in configuration and are planar; however, one of the first and second vanes is disposed so as to angle downwardly from the front to the rear relative to the shaft while the other vane is disposed to angle upwardly from front to rear relative to the shaft to induce rotation of the arrow shaft during flight. The support vanes can also be spiralled to induce rotation. Thus, the first and second vanes and the first and second support vanes provide four vanes from one integral piece of plastic and all of which perform an aerodynamic function.

24 Claims, 5 Drawing Figures

ARROW

This invention relates to an improvement in archery arrows and more specifically to a stabilizing vane means attached to the rearward end of the arrow shaft.

It has been common practice in the past to provide archery arrows with fletching feathers attached to the rear end of the arrow shaft to act as guide vanes. These vanes create drag upon the arrow to stabilize the flight of the arrow during its trajectory. Feathers have been utilized because they are soft and flexible and therefore flex upon striking the bow as the arrow is being released, thereby avoiding interference with the flight of the arrow. Because the feathers are flexible and soft, they rapidly wear. Accordingly, attempts have been made to substitute smooth, rigid vanes for the feathered vanes to provide the desired planing surfaces, yet avoiding wear problems. Because it is desirous to utilize rigid vanes, vane assemblies have been utilized where the planar surfaces forming the vanes are disposed entirely on one side of the arrow so that they do not interfere or engage the bow upon release of the arrow. Examples of such vane assemblies are shown in U.S. Pat. Nos. 3,106,400 and 3,756,602.

It has been recognized that the flight of an arrow is much more accurate when the arrow is properly rotated. This is particularly true with hunting arrows which have points which may plane or cause an adverse aerodynamic effect upon the arrow when not properly rotated. Another important consideration which must be given arrow vane systems is the ease by which attachment to the arrow shaft can be made. As will be appreciated, it is sometimes very difficult to attach feathered fletching to an arrow shaft, particularly in the field.

The instant invention overcomes some of the problems associated with the prior art vane assemblies in that the vane assembly of the instant invention may be easily attached to an arrow shaft yet provides surprising stability in the flight of the arrow. The instant invention relates to a vane for extending along the shaft of an arrow adjacent the rearward end of the shaft and including at least first and second vanes spaced from the shaft. The first vane is disposed to angle downwardly from front to rear relative to the shaft whereas the second vane is disposed to angle upwardly from front to rear relative to the shaft. This disposition of the vane induces rotation of the arrow during flight and results in surprising stability in the flight of the arrow. Additionally, the vane means of the instant invention is formed of an integral member which is wrapped around or otherwise secured to the arrow shaft in a manner to facilitate easy attachment of the vane means to the arrow shaft. Further, the vane means of the instant invention is disposed entirely on one side of the arrow so as not to engage the bow upon release and interfere with the flight of the arrow.

Other advantages of the present invention will be readily appreciated as the same becomes better understood by reference to the following detailed description when considered in connection with the accompanying drawings wherein.

Referring now to the drawings wherein like numerals indicate like or corresponding parts, an arrow constructed in accordance with the instant invention is generally shown at 10.

Figure 1:
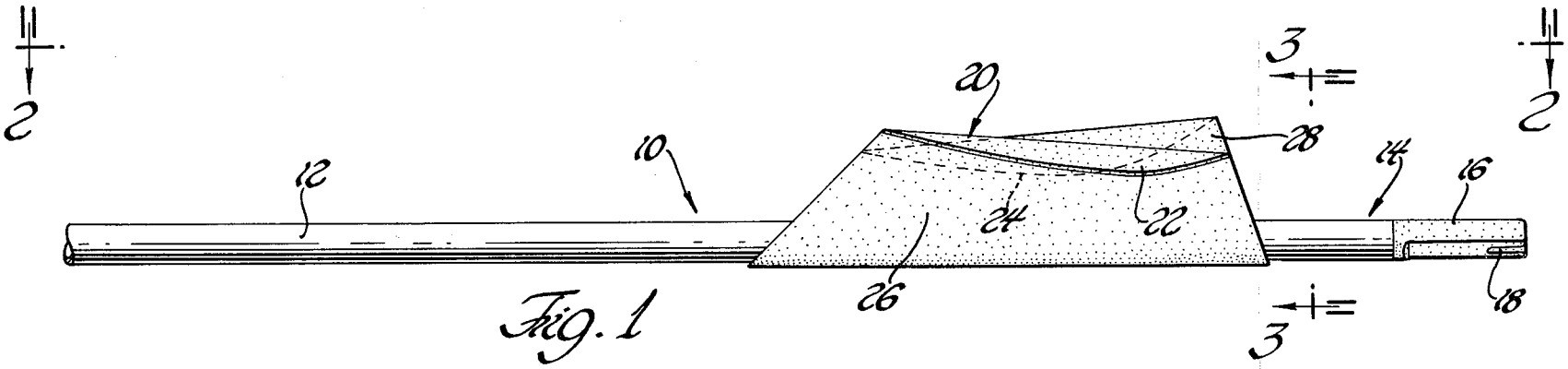
FIG. 1 is a fragmentary side elevational view of a preferred embodiment of the subject invention.

The arrow 10 includes a shaft 12 having a forward end (not shown) and a rearward end generally indicated at 14. The shaft 12 is circular in cross section and may be formed of metal such as aluminum or plastic. The forward end of the shaft may include a tip of the type utilized for target practice or a tip of the type utilized for hunting which is substantially larger and frequently planar in configuration.

The rear end of the arrow includes a fitting 16 having a notch 18 therein. As is well known in the archery art, the notch 18 engages the bowstring of an archery bow.

The arrow assembly includes a vane means generally indicated at 20. The vane means 20 extends along the shaft 12 adjacent the rearward end thereof.

The vane means 20 is preferably made of an integral piece of plastic. The vane means may be cut from a sheet of plastic and then formed into the configuration shown and specifically described hereinafter.

The vane means includes first and second vanes 22 and 24. The vanes 22 and 24 are spaced laterally from the axis of the shaft 12 and extend in a direction generally parallel or longitudinally of the shaft 12. However, the first vane 22 is disposed so that the plane of the vane 22 is disposed at an angle which extends downwardly from the front to the rear relative to the shaft 12. Conversely, the second vane 24 is disposed so that the plane of the vane extends at an angle upwardly from the front to the rear thereof relative to the shaft 12.

The vane means 20 also includes support means extending laterally from the shaft 12 to the first and second vanes 22 and 24. More specifically, the support means includes first and second support vanes 26 and 28. The support vanes 26 and 28 extend laterally, tangentially or generally radially of the shaft 12. The first vane 22 extends transversely or laterally from the first support vane 26 and the second vane 24 extends laterally or generally transversely from the second vane 28. As illustrated, the first and second vanes also slant downwardly in a direction laterally away from the respective legs but they may also slant upwardly or extend perpendicularly from the respective legs. Although not necessary, in the preferred embodiment the support vanes 26 and 28 are spaced from one another and are generally parallel to one another.

Figure 2:
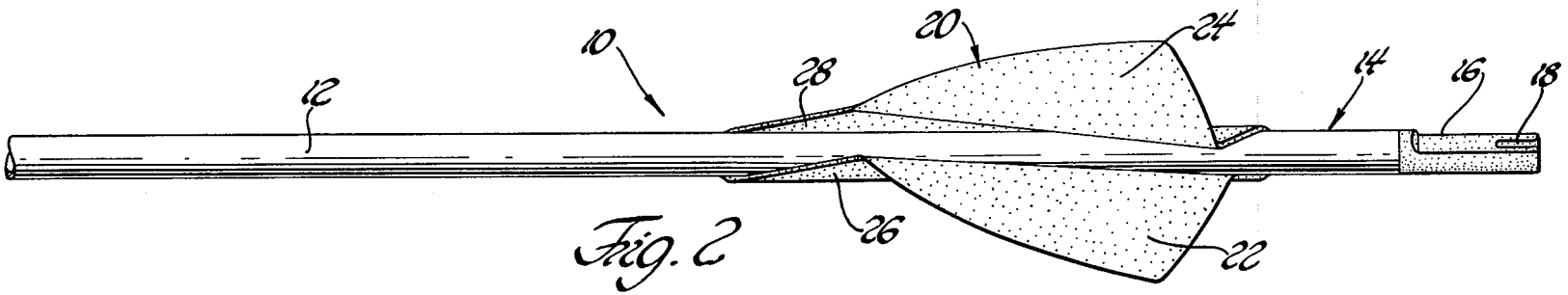
FIG. 2 is a view taken substantially along line 2—2 of FIG. 1.

Furthermore, the support vanes 26 and 28 may be spiralled and or disposed helically on a long lead about the arrow shaft 12, as best illustrated in FIG. 2. Thus, when the support vanes 26 and 28 are spiralled, they also produce an aerodynamic force tending to rotate the arrow during flight. It has been found that a cross wind will inhibit or stop rotation of an arrow using the prior art vane systems; however, when all four vanes 22, 24, 26 and 28 induce rotation, it has been found that cross winds have little if any effect upon the rotation of the arrow.

Additionally, when the support vanes are spiralled and spaced, there is not a smooth flow of air between the support vanes and consequently a drag is produced which adds further stability to the flight of the arrow.

The support vanes 26 and 28 are interconnected by a base portion 30. The base portion 30 is arcuate or semi-circular and extends about the shaft 12 approximately 180°. The vane means 20 may be secured to the shaft 12 by an adhesive or the like, disposed between the shaft 12 and the arcuate base portion 30.

The notch 18 in the rearward end of the arrow extends diametrically through the shaft 12 at an acute angle relative to the planes of the support vanes 26 and 28. More specifically, the planes of the support vanes 26 and 28 extend at an angle of approximately 45° relative to the notch 18 so that the vane means 20 extends upwardly and away from the bow when the notch 18 engages the bowstring. In this position the vane means 20 will not engage the bow when the arrow is released.

Figure 3:
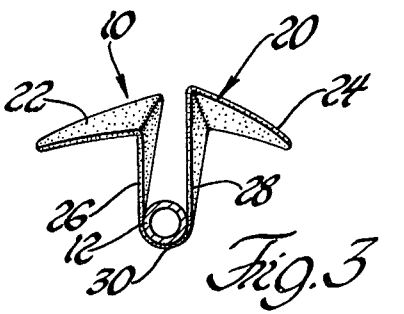
FIG. 3 is a cross-sectional view taken substantially along line 3—3 of FIG. 1.
Figure 4:
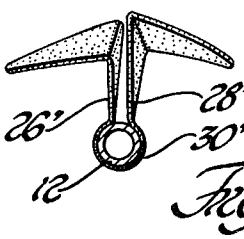
FIG. 4 is a view similar to FIG. 3 but showing an alternative embodiment.

The embodiment of FIG. 4 differs from that of FIGS. 1 through 3 in that the base portion 30' which interconnects the support vanes 26' and 28', extends more than 180° about the arrow shaft 12. Because the base portion 30' extends more than 180° about the arrow shaft, the vane means may be snapped onto the shaft as it is being adhesively secured thereto so as to remain in position while the adhesive dries to secure the vane means in position.

Figure 5:
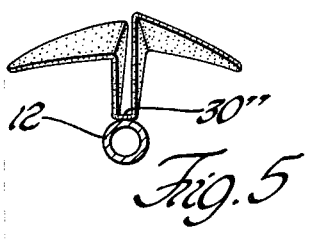
FIG. 5 is a view similar to FIGS. 3 and 4 but showing yet another alternative embodiment of the subject invention.

The embodiment of FIG. 5 differs from the previously described embodiments by a base portion 30'' which rests upon the shaft 12. The base portion 30'' may be flat as illustrated or may be slightly arcuate to engage the arrow shaft 12.

In all embodiments the first and second vanes 22 and 24 have leading edges or outer peripheries which taper outwardly from the support vanes 26 in a direction from the front to the rear thereof. In other words, the first and second vanes 22 and 24 are generally triangular in configuration. As illustrated, the trailing edges of the outer periphery of the first and second vanes 22 and 24 are tapered inwardly; however, the trailing edges may be perpendicular to the axis of the shaft 12. It will also be noted that the planes of the first and second vanes 22 and 24 cross or intersect one another between the leading and trailing edges thereof. Said another way, the leading edge of the first vane 22 is at a higher position or farther away from the shaft 12 than is the leading edge of the second vane 24.

As will be appreciated, during the flight of the arrow air strikes the bottom of the vane 22 creating a force tending to move the vane 22 in a clockwise direction as viewed from the rear of the arrow. At the same time air strikes the top of the vane 24 tending to move the vane 24 also in a clockwise direction as viewed from the rear of the arrow. Thus, both vanes 22 and 24 produce an aerodynamic effect which causes the arrow to rotate in a clockwise direction as viewed from the rear. Of course it will be appreciated that in the event it is desired to rotate the arrow in the opposite or counterclockwise direction the position of the vanes 22 and 24 are reversed so that the vane 22 would slant upwardly from front to rear and vane 24 would slant downwardly from front to rear. Furthermore, when the support vanes are spiralled they also induce rotation of the arrow. In the preferred embodiment all four vanes 22, 24, 26 and 28 induce rotation although only vanes 22 and 24 may be used to do so in some situations. Needless to say the support vanes would be spiralled in the direction to abet the inducement of rotation of the arrow by the first and second vanes.

Additionally, the spacing between the support vanes 26 and 28 causes a drag effect which further stabilizes the flight of the arrow, it being appreciated that the support vanes 26 and 28 are aerodynamic foils or vanes extending from front to rear of the assembly. In other words, air is trapped between the walls of the support vanes 26 and 28 to produce a drag or beneficial aerodynamic effect which stabilizes the flight of the arrow. This is particularly significant when the support vanes 26 and 28 are spiralled about the arrow shaft.

It will be appreciated that no special fixture is required for attaching the vane means to the arrow shaft because the vane means may easily be attached to the shaft by merely gluing the vane means to the shaft as the configuration of the vane means facilitates its placement upon the shaft.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An arrow comprising a shaft with a forward end and rearward end, vane means extending along said shaft adjacent said rearward end, said vane means including first and second vanes spaced from said shaft and on the same side of said shaft, said first vane being disposed to angle downwardly from front to rear relative to said shaft and said second vane being disposed to angle upwardly from front to rear relative to said shaft, said vanes being substantially coextensive with one another longitudinally of said shaft.

2. An arrow as set forth in claim 1 wherein said vane means includes support means extending laterally from said shaft to said first and second vanes.

3. An arrow as set forth in claim 2 wherein said support means includes a first support vane extending laterally from said shaft and a second support vane extending laterally from said shaft, said first vane extending from said first support vane and said second vane extending from said second support vane.

4. An arrow as set forth in claim 3 wherein said first and second support vanes are spaced from one another.

5. An arrow as set forth in claim 4 wherein said vane means is defined by one integral member.

6. An arrow as set forth in claim 3 wherein said support means includes a base portion interconnecting said first and second support vanes.

7. An arrow as set forth in claim 6 wherein said first and second support vanes are spaced and generally parallel to one another.

8. An arrow as set forth in claim 7 wherein said support vanes are helically disposed on a long lead about said arrow shaft.

9. An arrow as set forth in claim 7 wherein said base portion extends approximately 180° about said shaft.

10. An arrow as set forth in claim 7 wherein said base portion extends more than 180° about said shaft.

11. An arrow as set forth in claim 7 wherein said arrow has a notch in said rearward end and said notch extends diametrically through said shaft at an acute angle relative to the planes of said first and second support legs.

12. An arrow as set forth in claim 6 wherein said base portion is arcuate and extends about said shaft.

13. An arrow as set forth in claim 2 wherein said support means includes at least one support vane disposed helically on a long lead about said arrow shaft.

14. Vane means of the type for attachment to an arrow shaft comprising: support means having first and second ends and adapted at said first end for attachment to the shaft of an arrow, first and second vanes extending from said second end of said support means, said first vane being disposed to angle downwardly from front to rear and said second vane being disposed to angle upwardly from front to rear, said first and second vanes extending from said support means in opposite directions and being substantially coextensive with one another from front to rear.

15. Vane means as set forth in claim 14 wherein said support means includes a base portion adapted to engage the shaft of an arrow, a first support vane extending from said base portion, and a second support vane extending from said base portion, said first vane extending from said first support vane, said second vane extending from said second support vane.

16. Vane means as set forth in claim 15 wherein said first and second support vanes are spaced from one another.

17. Vane means as set forth in claim 16 wherein said support vanes extend in a spiralled path.

18. Vane means as set forth in claim 15 defined by one single integral member.

19. Vane means as set forth in claim 15 wherein said base portion is arcuate for extending about the shaft of an arrow.

20. Vane means as set forth in claim 19 wherein said support vanes are generally parallel to one another.

21. Vane means as set forth in claim 20 wherein said support vanes extend in a spiralled path.

22. Vane means as set forth in claim 15 wherein said first and second vanes have outer peripheries which taper outwardly from said support means in a direction from front to rear thereof.

23. Vane means as set forth in claim 14 wherein said support means includes at least one support vane which extends in a spiral path to abet said first and second vanes in inducing rotation of said arrow.

24. Vane means of the type for attachment to an arrow shaft comprising: support means having first and second ends and adapted at said first end for attachment to the shaft of an arrow, first and second vanes extending from said second end of said support means, said first and second vanes extending from said support means laterally in opposite directions and being substantially coextensive with one another from front to rear, said first and second vanes being disposed in respective planes which cross one another as viewed in side elevation with respect to said support means.

* * * * *